US010772435B2

(12) United States Patent
Bergin

(10) Patent No.: US 10,772,435 B2
(45) Date of Patent: Sep. 15, 2020

(54) PORTABLE CUSTOMIZABLE SWIVELING CONCESSION TRAY

(71) Applicant: Caddy Products, Inc., Palm Desert, CA (US)

(72) Inventor: Peter W. A. Bergin, Rancho Mirage, CA (US)

( * ) Notice: Subject to any disclaimer, the term of this patent is extended or adjusted under 35 U.S.C. 154(b) by 808 days.

(21) Appl. No.: 15/148,823

(22) Filed: May 6, 2016

(65) Prior Publication Data

US 2017/0318974 A1 Nov. 9, 2017

(51) Int. Cl.

| | |
|---|---|
| ***A47C 7/70*** | (2006.01) |
| ***A47C 7/62*** | (2006.01) |
| ***A47C 1/12*** | (2006.01) |
| ***B65D 1/36*** | (2006.01) |

(52) U.S. Cl.

CPC ..... *A47C 7/70* (2013.01); *A47C 1/12* (2013.01); *A47C 7/62* (2013.01); *B65D 1/36* (2013.01)

(58) Field of Classification Search

CPC ..... A47C 7/70; A47C 1/12; B65D 1/36
USPC ..... 297/188.14, 188.18
See application file for complete search history.

(56) References Cited

U.S. PATENT DOCUMENTS

| | | | | |
|---|---|---|---|---|
| 3,498,470 A | | 3/1970 | Thomas | |
| 4,511,072 A | | 4/1985 | Owens | |
| 5,118,063 A | * | 6/1992 | Young, Sr. | A47G 23/06 248/311.2 |
| D368,627 S | | 4/1996 | McSpadden | |
| 5,720,516 A | * | 2/1998 | Young | A47C 7/68 297/188.14 |
| 5,732,849 A | | 3/1998 | Brooks | |
| 5,865,124 A | * | 2/1999 | Wroe | A47C 7/70 108/157.11 |
| 5,971,139 A | | 10/1999 | Bradley | |
| 6,109,580 A | * | 8/2000 | Stern | A47G 23/06 248/311.2 |
| 6,412,862 B1 | * | 7/2002 | Dickerson | A47C 7/70 297/161 |
| 6,732,990 B2 | | 5/2004 | Hudson | |
| 7,243,991 B2 | * | 7/2007 | Ojeda | B60N 3/002 297/188.14 |
| 7,290,746 B1 | * | 11/2007 | Macias | A47C 7/70 108/42 |

(Continued)

FOREIGN PATENT DOCUMENTS

| | | |
|---|---|---|
| CN | 201349923 Y | 11/2009 |
| CN | 201431278 Y | 3/2010 |

(Continued)

*Primary Examiner* — Bryon P Gehman
(74) *Attorney, Agent, or Firm* — Westman, Champlin & Koehler, P.A.; Z. Peter Sawicki; Amanda M. Prose

(57) ABSTRACT

A concession tray and container holder removably securable to a pre-existing container holder and which is connected to the container holder such that the tray and container holder can swivel or otherwise be movable about the connection of the tray to the seat. The connection comprises a customizable insert which can be of different heights such that the same tray can be connected to various different pre-existing container holders such as those of different seating configurations. The connecting insert is a generally cylindrical connecting portion having a first end configured for connection to the tray and a second end for inserting into the pre-existing container holder.

19 Claims, 9 Drawing Sheets

(56) References Cited

U.S. PATENT DOCUMENTS

| | | | | |
|---|---|---|---|---|
| 9,084,491 | B1 * | 7/2015 | Kattan | A47B 5/00 |
| 2001/0032791 | A1 | 10/2001 | Hudson | |
| 2005/0199667 | A1 | 9/2005 | Cappellino et al. | |
| 2007/0029850 | A1 * | 2/2007 | Weng | A47C 7/70 297/161 |
| 2014/0252812 | A1 * | 9/2014 | Ton | F16M 11/06 297/170 |

FOREIGN PATENT DOCUMENTS

| | | | | |
|---|---|---|---|---|
| CN | 203186179 | U | 9/2013 | |
| DE | 202011105488 | U1 | 11/2011 | |
| GB | 2276531 | A * | 10/1994 | B65D 25/24 |

* cited by examiner

PORTABLE CUSTOMIZABLE SWIVELING CONCESSION TRAY

BACKGROUND OF THE INVENTION

The present invention relates to a concession tray that can be mounted on the armrest of a seat. In particular, the present invention relates to a concession tray having a container holder, wherein the container holder can be removably mounted to the armrest of a seat by connection with a pre-existing container holder portion of the arm rest.

In stadiums, arenas and theaters, a common problem is the lack of a place to rest concessions, beverages and other items. Often, concessions are placed on the lap of the user or on the arm of a seat only to be accidentally knocked over or otherwise spilled. In the alternative, the occupant of a seat must hold the containers, thereby restricting the use of his/her hands.

A number of concession holders or trays have been used to alleviate the problem mentioned above. One type of holder is fixedly mounted to a seat. A second type of holder is a tray configured to rest on a user's lap. A third type of tray has extendable leg portions to provide a tray surface resting on a ground surface and positionable near a user.

SUMMARY

An aspect of the present disclosure relates to a tray and container holder that is removably securable to a pre-existing container holder, for example, a container holder in an arm rest of a seat. The tray and container holder are also connected to swivel with respect to the pre-existing container holder such that the tray and the container holder can swivel or otherwise be movable about the connection of the tray to the pre-existing container holder. The tray is thus selectively positionable with respect to the seat. The tray and container holder comprises a generally flat surface configured for supporting one or more concessions thereon and having at least one aperture therein and the cylindrical connecting portion comprises a first end configured to form a container holder portion of the tray; a second opposing end configured for insertion into a pre-existing cup holder of a seat; and a length connecting the first end and the second end wherein the length is configured for adjusting the height of the tray over the pre-existing cup holder. The connecting portion connects the tray to the container holder of the seat and allows the tray to be raised and swiveled about the connection of the second opposing end of the connecting portion and the pre-existing container holder of the seat, allowing the tray to be selectively moved from a first position to a second position.

Another aspect of the present disclosure relates to the cylindrical connecting portion being a component separate from the tray itself. The cylindrical connecting portion may be forming as an insert that is configured for removable connection with an aperture in the tray. The first end of the insert is configured for insertion into a secured connection with the aperture of the tray. The second end of the insert is configured for insertion into, and for swiveling connection with the pre-existing container holder of the seat. The first end of the insert includes a cavity that when the insert and connected to the tray, the cavity serves as the container holder portion of the concession tray of the present disclosure.

In yet another aspect of the present disclosure, the insert may be made as an integral part of the concession tray.

Within this aspect, the insert is inserted into the pre-existing container holder of the seat, producing a swiveling connection with respect to the seat.

Yet another aspect of the present disclosure comprises further providing a cover to the concession tray where the cover provides a raised, substantially flat working surface. When the cover is secured to the top of the tray, any raised perimeter is eliminated, providing a substantially smooth and accessible working surfaces.

Another aspect of the present disclosure relates to the connecting portion, or insert. The length between the first end and the second is a riser that can have various heights. Different riser heights may be needed to accommodate different seats or different pre-existing container holder configurations.

Yet another aspect of the present disclosure relates to a method of removably securing a tray and container holder to swivel with respect to a seat. The method comprises providing a generally flat surface configured for supporting one or more concessions thereon and having a cylindrical connecting portion having a first end and a second end. Inserting the second end of the connecting portion into a pre-existing container holder of the seat such that the first end of the connecting portion is generally upright and configured to receive a beverage container therein. The method further comprises swiveling the tray about the connecting portion to a selected position for use and to a second selected portion different than the first position. The method then may further comprise removing the second end of the connecting portion from the pre-existing container holder of the seat when the tray is no longer needed.

DETAILED DESCRIPTION

Figure 1:
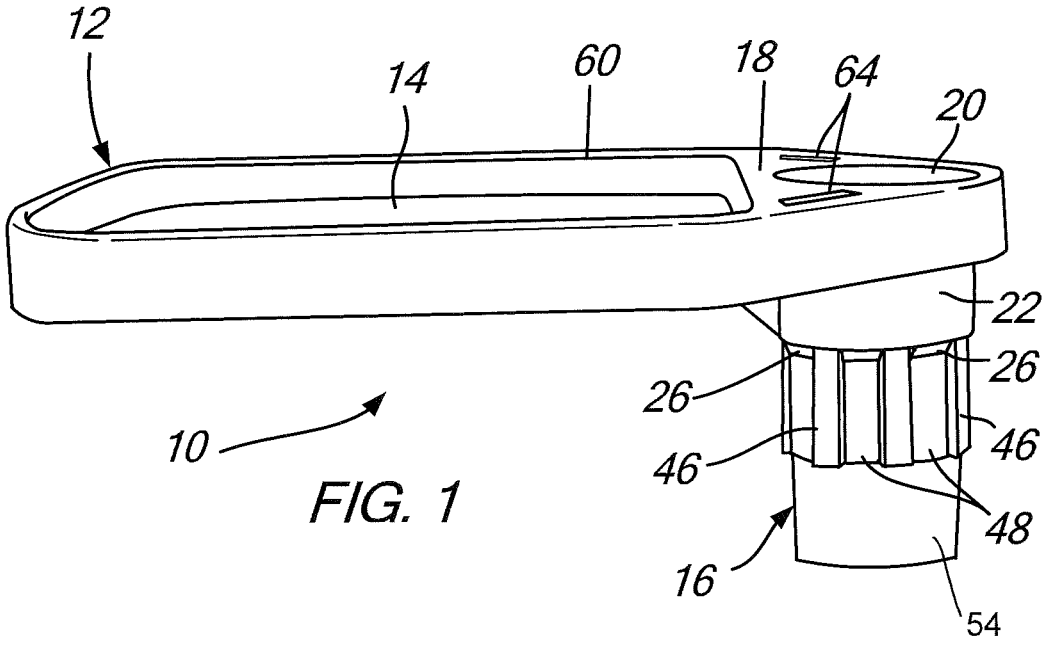
FIG. 1 is a side perspective view of a concession tray and connected container holder of the present disclosure.
Figure 2:
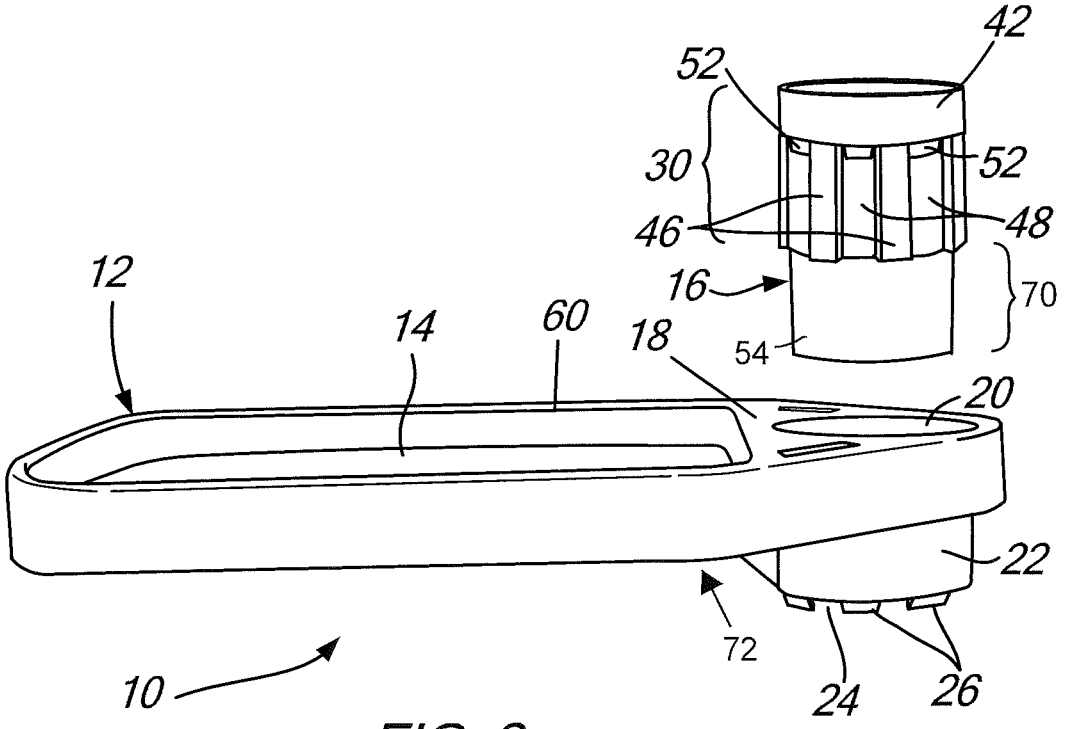
FIG. 2 is a side perspective view of the concession tray and the connecting container portion separated from one another.

A concession tray and container holder of the present invention is generally illustrated in FIG. 1 at 10. The concession tray and container holder 10 comprises a tray 12 and a connecting container portion 16, also referred to throughout this disclosure as a container holder insert 16. The tray 12 comprises a generally flat surface 14 providing a space for placement of concessions, containers, devices and/or various other accessories. The tray 12 also comprises a second generally flat surface 18 that is raised with respect to first flat surface 14 and is adjacent to the first flat surface 14. The raised surface 18 is adapted with an integral aperture 20 that is configured to receive the container holder insert 16. Additionally, a cover 74 is configured for secure attachment over the first generally flat surface 14, providing a raised third generally flat surface 114, which is substantially level with the second flat surface 18. The cover 74 provides an alternative surface that does not have a raised perimeter.

Referring to FIG. 1, the aperture 20 may be circular in shape or otherwise have a dimension corresponding to a perimeter dimension of the insert 16. The aperture 20 in surface 14 is configured with a side wall perimeter 22 integrally extending away a selected distance from the aperture 20 and tray surface 18. For example, the side wall perimeter 22 extends below the tray a distance beyond a bottom surface of the tray 12. A distal terminal end 24 of the side wall perimeter 22 is configured with protrusions, or tabs, 26 that extend from the side wall perimeter a selected distance and are angled inwardly from the side wall perimeter 22 so that the tabs 26 are inwardly oriented. The tabs 26 are spaced apart along the perimeter wall 22.

Figure 6:
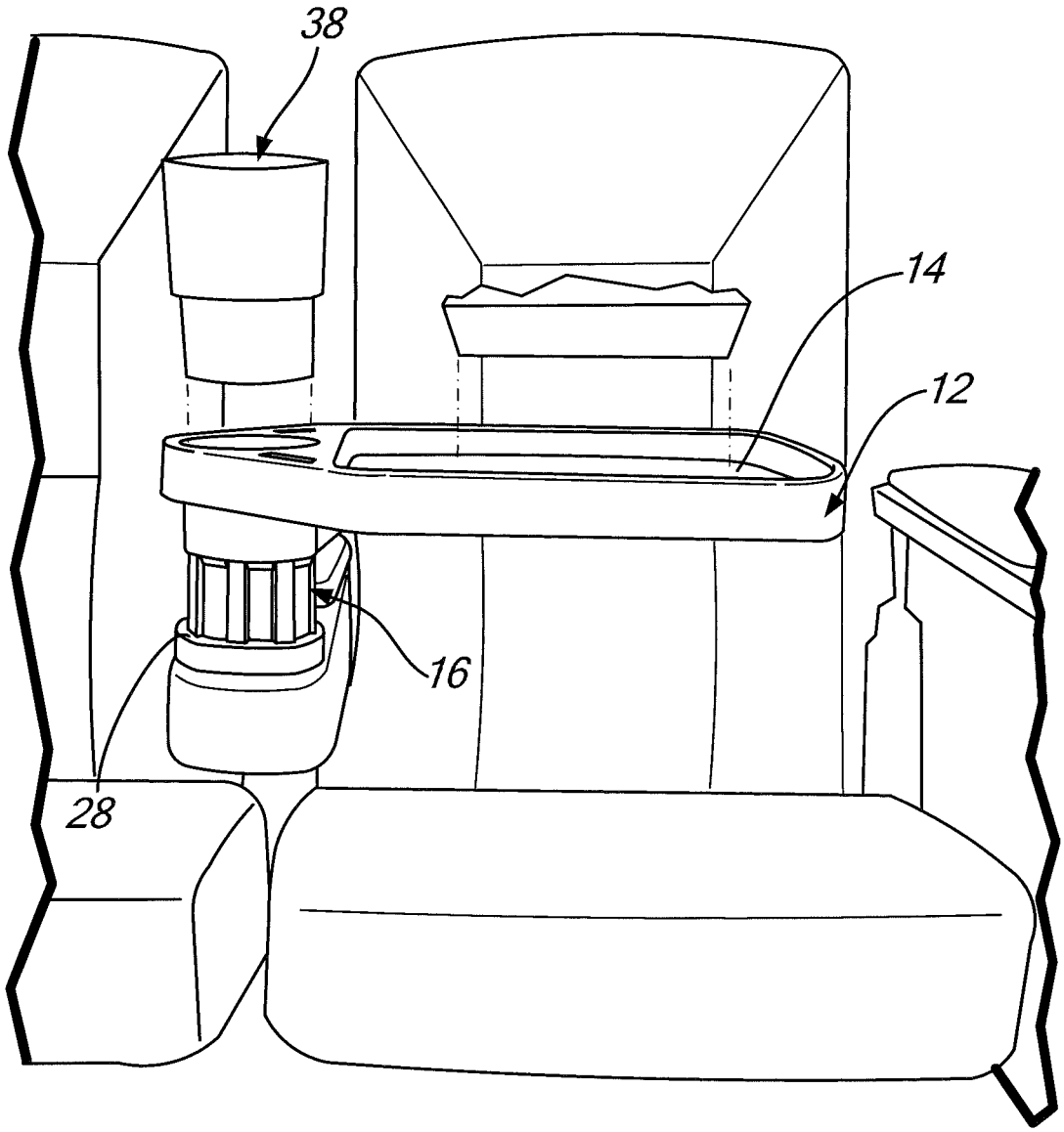
FIG. 6 is front perspective view of the concession tray and connected container holder in use in a seat having a pre-existing container holder.
Figure 7A:
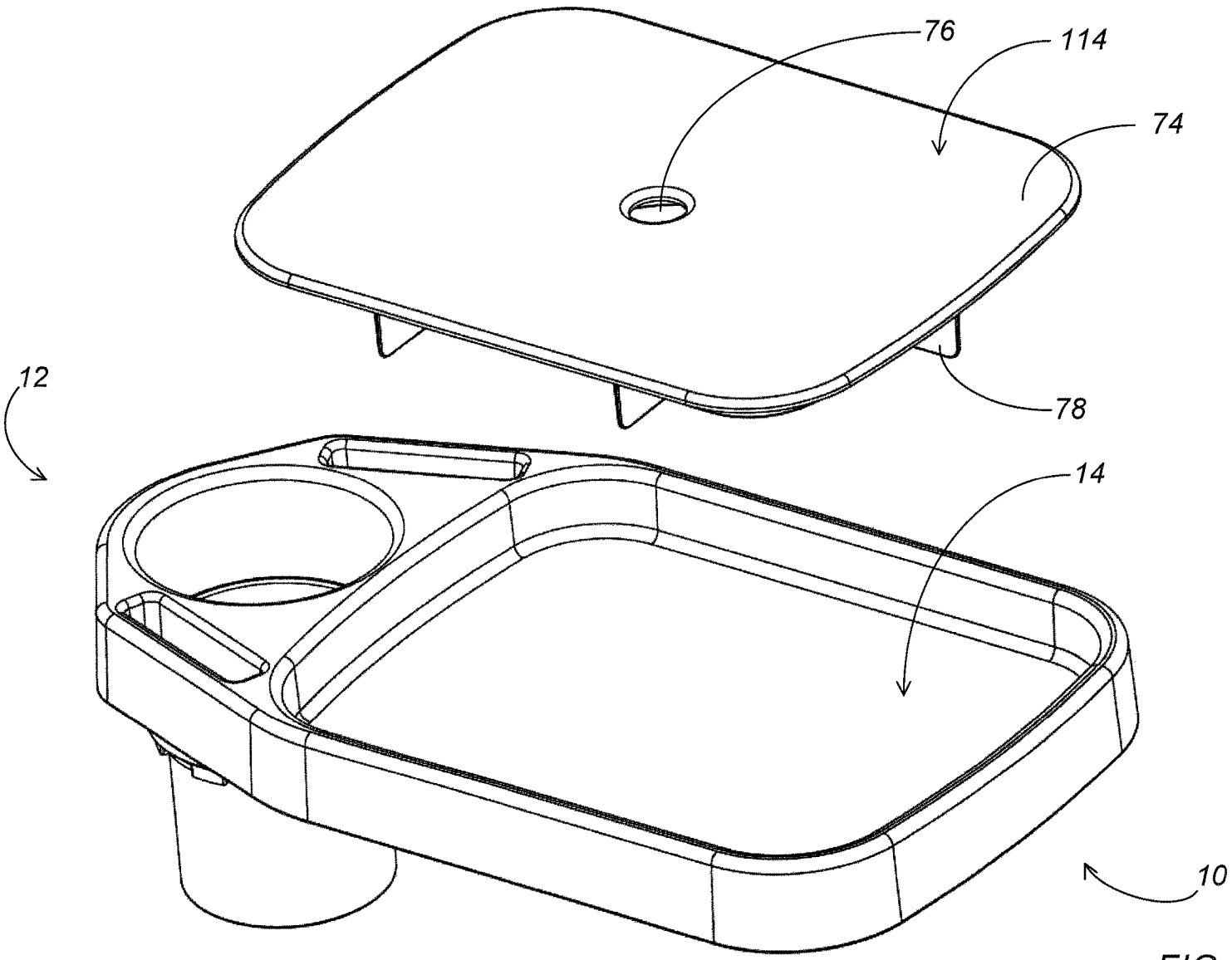
FIG. 7A is a top perspective view of the concession tray and connected container holder with a cover portion for securing thereto.
Figure 7B:
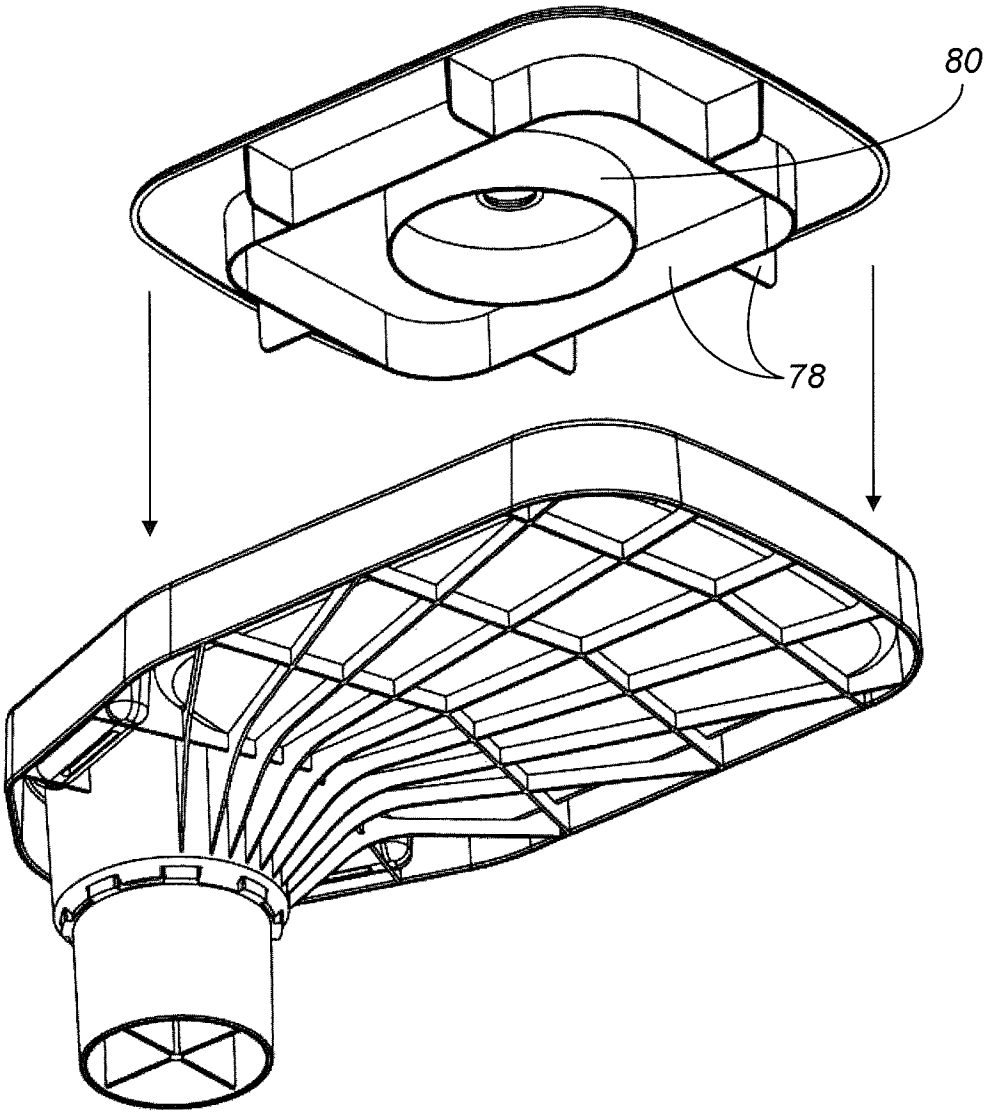
FIG. 7B is a bottom perspective view of the concession tray and connected container holder with the cover portion for securing thereto.
Figure 8:
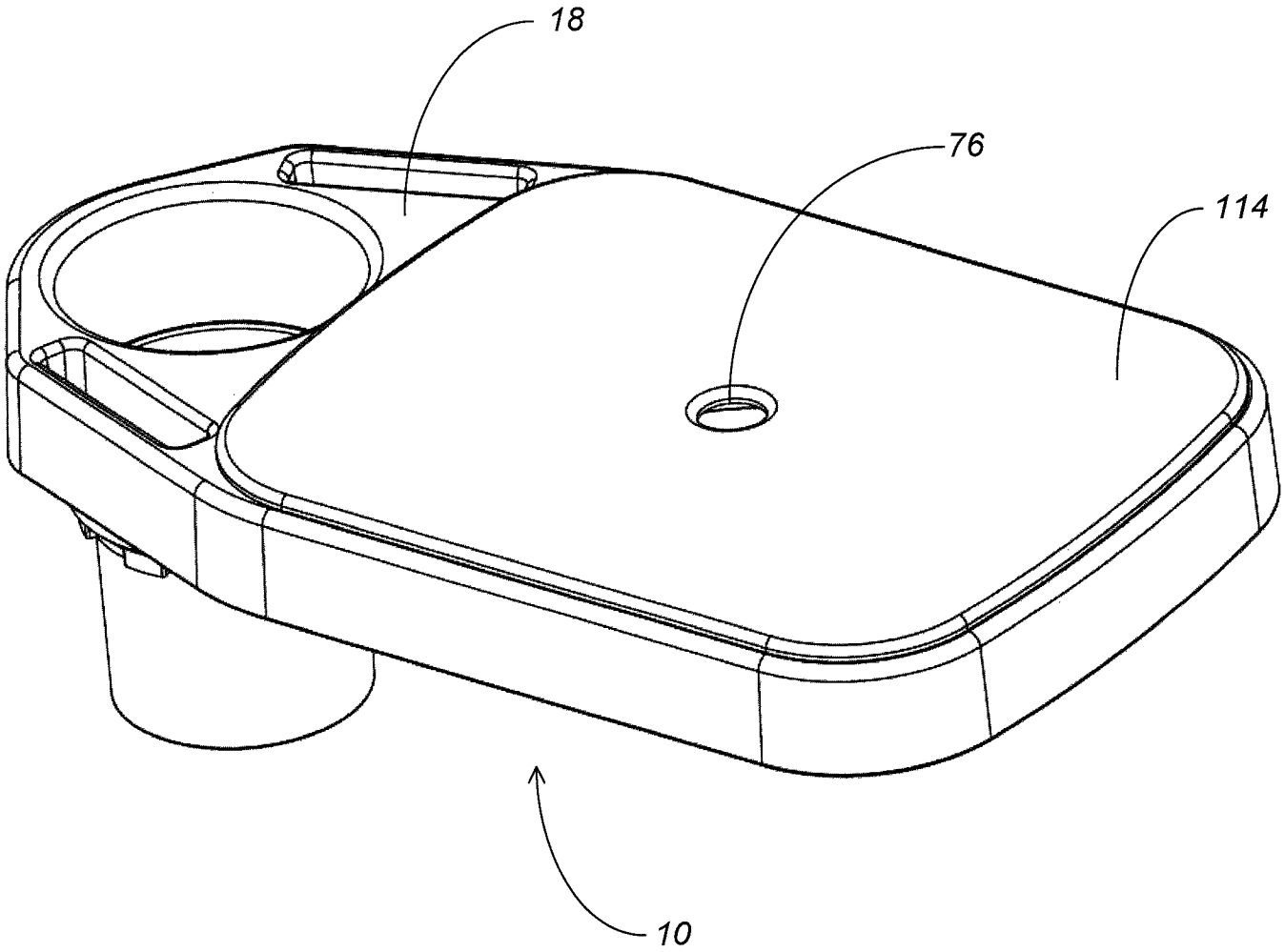
FIG. 8 is a perspective view of the concession tray and connected container holder with the cover portion in use.
Figure 9:
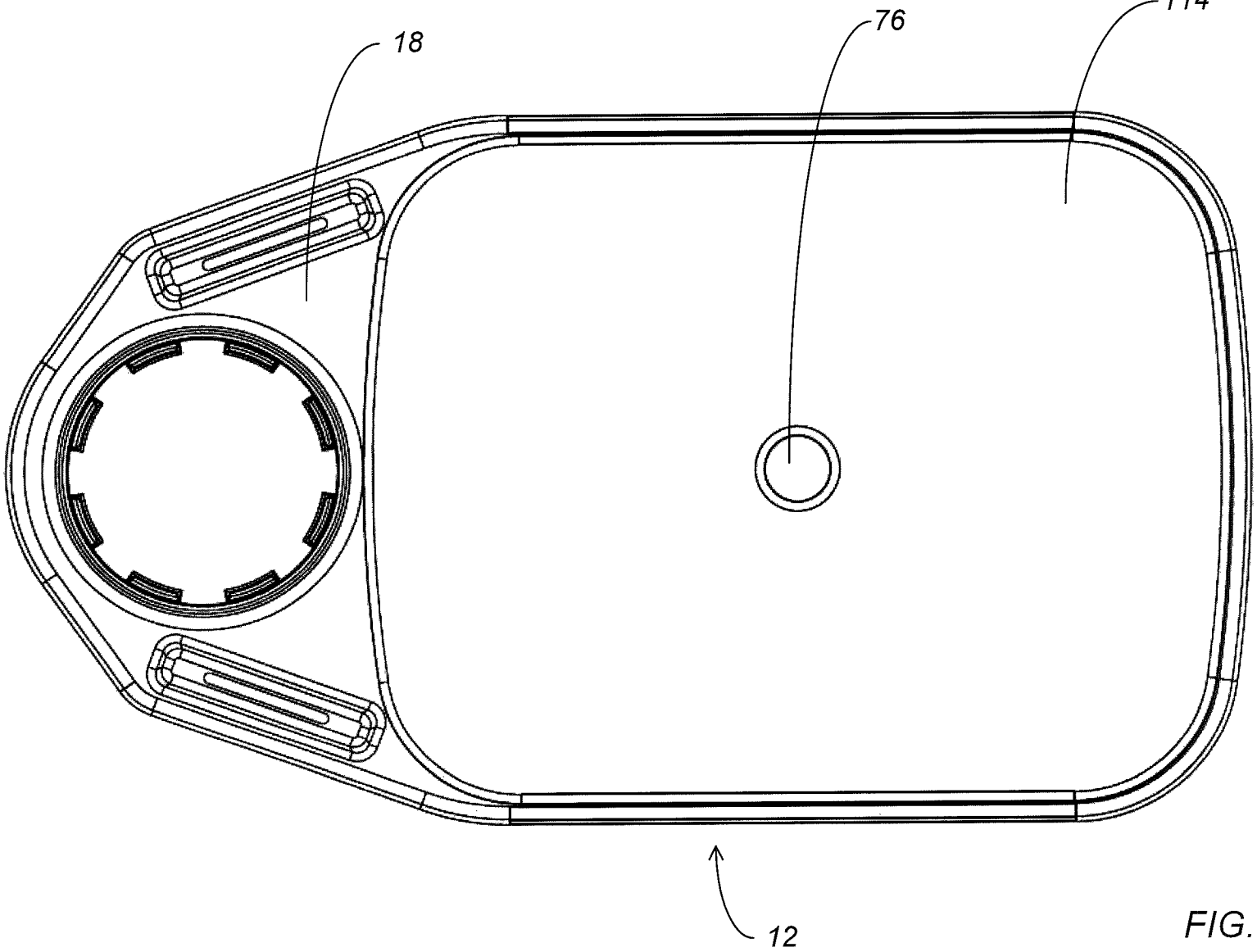
FIG. 9 is a top view of the concession tray and connected container holder with the cover portion in use.
Figure 10:
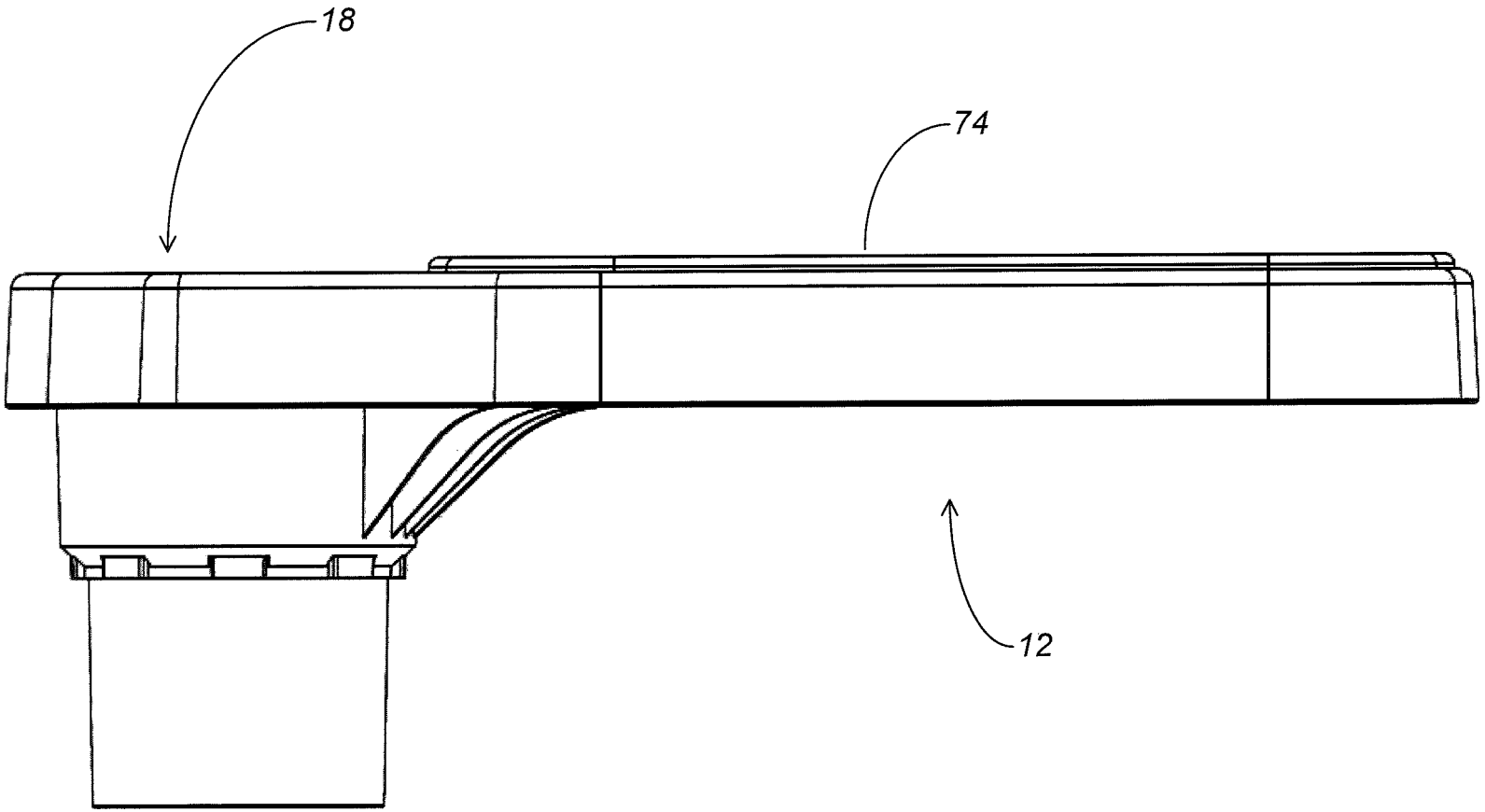
FIG. 10 is a side view of the concession tray and connected container holder with the cover portion in use.

The container holder insert 16 is configured for insertion into aperture 20 and for connection to the tray 12. In general, the container holder comprises a top or upper portion which is also referred to a "common insert"; a "riser portion" which can be provided in various heights and dimensions; and a bottom or lower portion which is a cup insert portion. The riser portion is a cylindrical length between the ends of the insert 16 and connects the common insert and the cup insert portions. The container holder insert 16 may be a generally cylindrical insert 16 having a diameter configured for slidable insertion into the aperture 20 and for secure connection thereto. The container holder insert 16 allows a user to secure the tray 12 to a pre-existing container holder 28 as the container holder insert 16 is configured for concurrent connection with the tray 12 and the container holder 28. The insert 16 allows a user to removably secure the tray 12 to a seat having an arm rest and container holder or to a seat having a container holder connected thereto as illustrated in FIG. 6. The insert 16 also allows for the user to be able to rotate or swivel the tray about the connection of the container holder insert 16 and container holder 28, allowing the user to select the position of the tray 12. Thus, the tray 12 can be secured to various seating configurations and the user can selectively move (swivel) the tray 12 from an elevated position elevated over the user's lap to an elevated position away from the user's lap (e.g. off to the side of the user).

Figure 3:
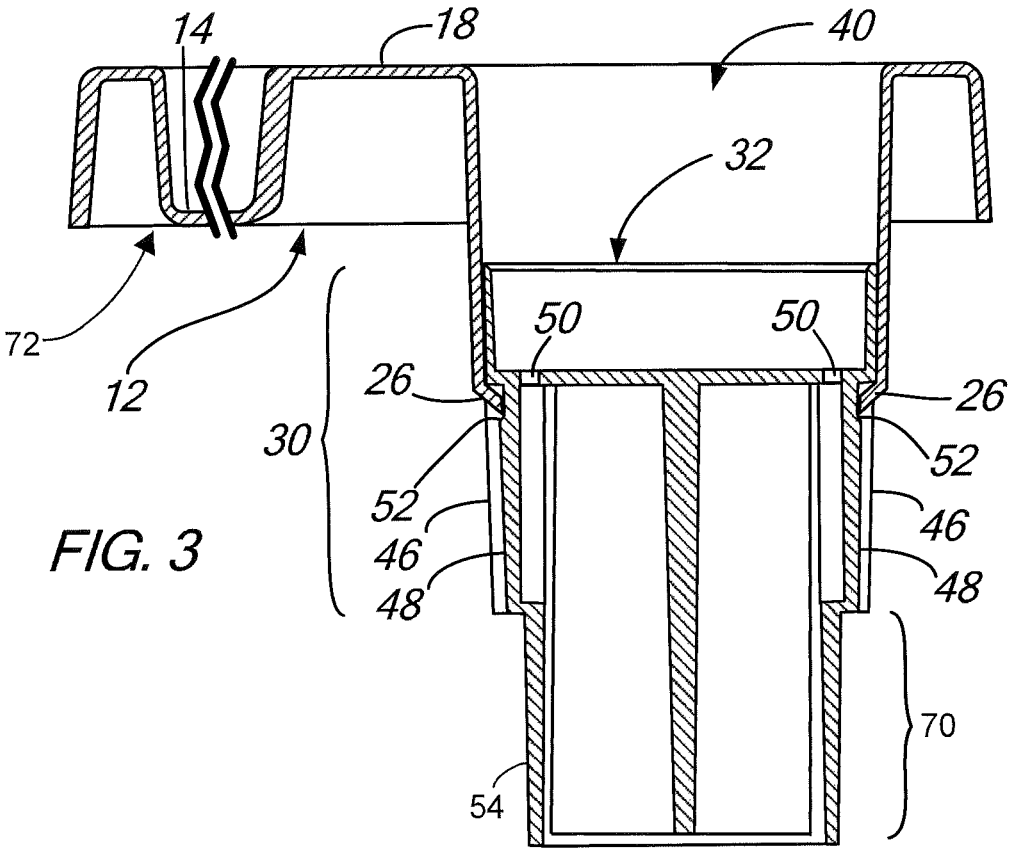
FIG. 3 is a cross-sectional view of the concession tray and connected container holder.
Figure 5:
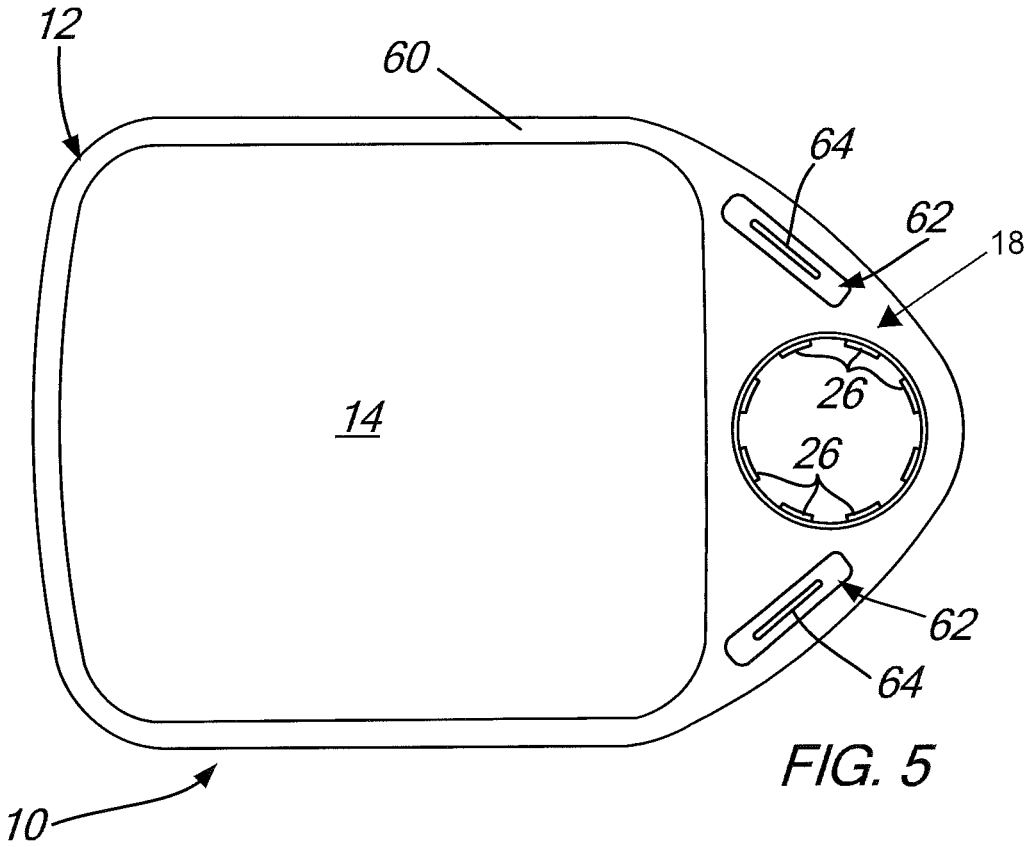
FIG. 5 is a top view of the concession tray.
Figure 4A:
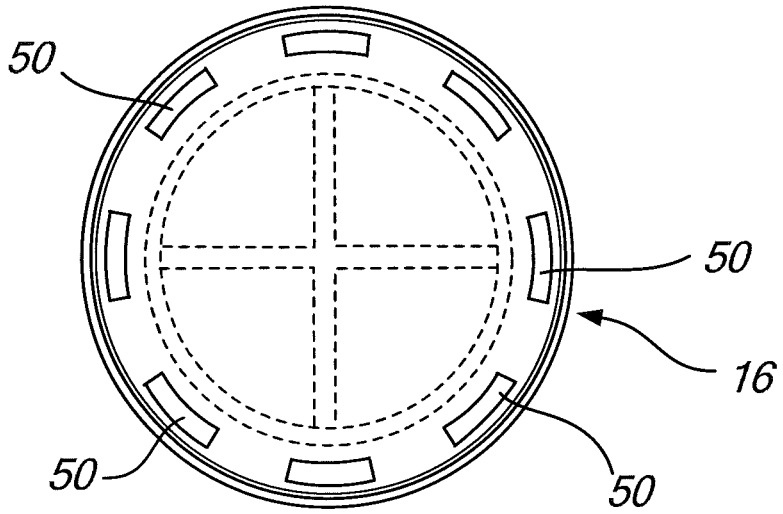
FIG. 4A is a top plan view of the connecting container portion.
Figure 4B:
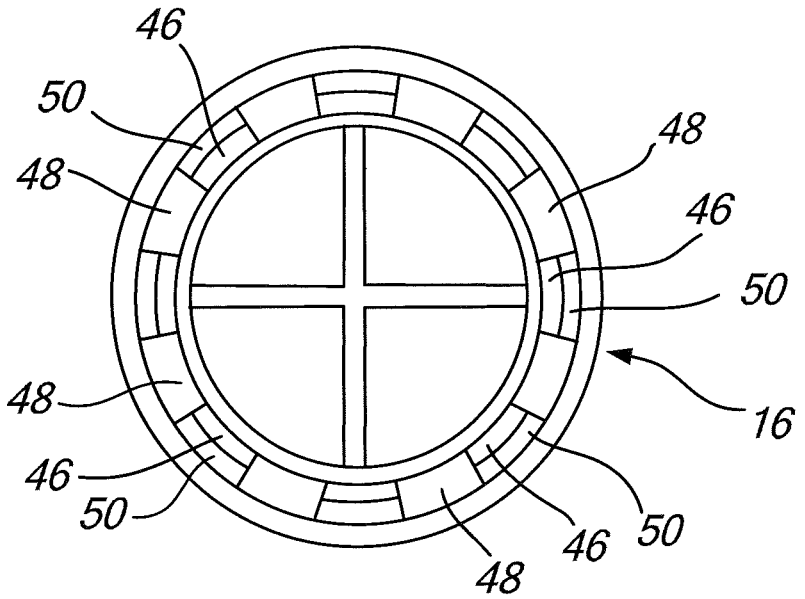
FIG. 4B is a bottom plan view of the connecting container portion.

As illustrated in further detail in FIGS. 3-4B, the container holder insert 16 is for example, generally in the shape of a cylinder. A first portion 30 of the container holder insert 16 is an upper portion 30, which is the common insert 30. The common insert 30 has a generally flat recessed surface 32 on its top 42 and a corresponding side wall 34 extending upwardly from the recessed surface 32 providing a space 36 configured for receiving a container 38. This portion is configured to allow the insert 16 to simultaneously connect the tray 12 to a seat while still providing a container holder 40 portion of the tray 12. The tray 12 is removably connectable to a pre-existing container holder 28 without eliminating a holder for the user's beverage container.

The portion of the insert 16 below the common insert 30 is referred to as a riser portion. Integrally extending from an exterior surface of an outer facing side wall are a plurality of integral and spaced apart guide portions, or tabs 46. The tabs 46 are spaced circumferentially around the perimeter of the side wall and the tabs 46 extend a length downwardly and away from the upper portion 30. The tabs are connected by a ring 48 positioned behind the tabs 46 and connected to a back surface of each tab 46. The ring 48 is also integrally connected to the body of the insert. The tabs 46 provide guide portions, each having a width and space therebetween. Between each tab 46, as the ring 48 does not extend to a top portion of the insert, a space between the ring and the upper portion 42 of the insert forms a plurality of openings or spaces 50 that are circumferentially spaced apart around the area of the insert 16. The openings 50 are generally positioned where an upper portion of the tabs 46 begin to extend from the side wall 34 and the recessed surface 32. The openings or spaces 50 may be generally rectangular in shape (or have a shape otherwise configured for connection with the shape of tabs 26) and otherwise positioned between two adjacent guides or tabs 46. As discussed further below, these spaces 50 form a securing mechanism 52 which allows the user to secure the container holder insert 16 to the tray 12 by way of connection with tabs 26.

A lower portion 54 of the container holder insert 16 is configured for insertion with the pre-existing container holder 28. As illustrated in the figures, the lower portion 54 is a generally cylindrical portion having a diameter substantially equal to the recessed surface 32 and a length extending from the recessed surface 32 to a selected distance below the terminal end of the tabs 46 and the ring 48. The lower portion 54 thus integrally extends from the recessed surface 32. The diameter of the lower portion is also less than the diameter of the ring 48 such that the tabs 46 extend around the lower portion 54. The length 56 of the lower portion 54 is the length extending from the end of the tabs 46. The lower portion 54 may be substantially hollow or otherwise hollow with structural reinforcement therein along length 56. The length 56 may also be varied depending on the container holder with which the tray 12 will be used in connection with. Length 56 will fit into the container holder 28 and frictionally engage with an inner surface of the container holder 28. The length 56 also prevents tipping of the tray 12 by providing a counter force within the container holder 28. Thus, a longer length 56 as contacting the entire inner surface area of the container holder 28 further secures the tray 12 during use and rotation.

The mechanism 52 for removably securing the container holder insert 16 in the aperture 20 and to the tray 12 comprises tabs 26 and spaces 50. When the container holder insert 16 is inserted into the aperture 20, the lower portion 54 being inserted first through the aperture 20, the tabs 26 will engage with the spaces 50 when aligned and an application of pressure will secure the tabs 26 by interlocking the tabs into the spaces 50. The engagement of the tabs 26 and spaces 50 will securely attach the container holder insert 16 to the tray 12 effectively forming the concessions tray and container holder 10. This device 10 can then be removable and swivelably inserted to swivel in the pre-existing container holder 28. The securing mechanism 52 prevents vertical sliding of the tray 12 along the container holder insert 16 (or vice versa) when assembled.

The first flat surface 14 of the tray 12 will then be substantially horizontal to and positioned over a user's lap when the container holder insert 16 is connected to the tray 12 and the insert 16 is placed and secured into the pre-existing container holder 28. The flat surface 14 may be a lowered or recessed portion that is bounded by a raised lip or edge 60 around its perimeter. The raised lip 60 provides a deep side wall and thus a walled perimeter to the flat surface 14. The side wall may have a height in the range of approximately 0.5-2.0 inches and for example, a height of approximately 1.25 inches, the height being measured from the tray surface 14 to the upper rounded edge of the perimeter wall 60. The perimeter wall 60 secures concessions and other goods on the surface 14 and contains spills to the flat surface 14 of tray 12. One side length of the perimeter wall 60 may then smoothly blend along its upper perimeter edge into the second, raised surface 18. The aperture 20 is disposed within the raised surface 18. The raised surface 18 of the tray 12 may be further configured with at least one opening 62 wherein the opening 62 would also be integral to the tray 12 and the opening 62 being configured to provide a compartment 64 for receiving and supporting a device or small container, for example, a cell phone or similar device or a candy bar or food packaging container.

The tray 12 may have dimensions providing an overall polygon shape or other shape sufficient for supporting concessions on the flat surface 26 and for providing a beverage or container holder 34 and at least one compartment 64 for holding another container or device. For example, the tray 12 may be generally square in shape with rounded edges provided by the perimeter and having a triangular shape to the raised flat surface 18 configured with the aperture 20 for the container holder insert 16. The raised surface 18 which is integrally connected with and adjacent to the tray surface 14 may for example have a triangular shape also with rounded edges. The overall shape of the tray 12 allows the concession tray and container holder to be easily positioned in a pre-existing container holder 28 and moved/swiveled. The tray 12 may also range in size wherein the width (W) of the tray 12 (perimeter edge to perimeter edge) is in the range of approximately 10.0 inches to approximately 16.0 inches and more preferably within the range of approximately 11.0 inches to approximately 15.0 inches, and more preferably within the range of approximately 12.0 inches to 14.0 inches. The tray 12 may also range in size wherein the length (L) of the tray 12 (perimeter edge to perimeter edge including surface 18) is in the range of approximately 15.0 inches to approximately 22.0 inches and more preferably within the range of approximately 17.0 inches to approximately 21.0 inches. For example, the tray illustrated in the figures has an overall width (W) of approximately 14 inches and an overall length (L) of approximately 21 inches. Thus, the tray 12 may have a larger size than previous trays as the container holder insert 16 is configured to sufficiently support the larger size tray 12 in a stable and substantially horizontal manner by connection with the pre-existing container holder 28 while allowing the tray 12 to swivel about the pre-existing container holder 28 and container holder insert 16.

The concessions tray and container holder 10 may be formed of a plastic material or other suitable lightweight and durable material. Plastic compositions may be used as such compositions provide a device 10 that is easy to clean, is durable for multiple and repeated use and is light weight. Additionally, the tray 12 and the container holder insert 16 may be integrally formed through a molding process. The tray 12 and the container holder insert 16 may be formed separately as two interlocking pieces where the individual pieces reduce shipping costs for the device 10. However, it is also contemplated that the tray 12 and container holder insert 16 may be molded or otherwise formed as a single unit or piece. The design and components are substantially identical however the pieces are molded concurrently as a single device before shipping. When the concessions tray 10 comprises two pieces for assembly shipping costs are reduced, especially in arrangements wherein the dimensions of the tray 12 are increased. The producing of two pieces 12 and 16 configured to interlock also allows for the use of a tray 12 with one or more container holder inserts 16, where for example, the container holder inserts 16 have varying riser heights 65 or varying diameters or lengths 56 along the lower portion 52. This allows the concession tray and container holder 10 to be customizable for use with various pre-existing container holders 28 while the customizable device 10 remains removable and rotatable within the various pre-existing container holders 28.

The middle segment connecting the upper and lower portion of the container holder insert 16 is generally considered the "riser" 65. The container holder insert 16 is customizable in that both the upper portion 30 and the lower portion 54 are connected by the riser 65, which as discussed above, can be of varying heights and can be produced with varying dimensions while still being fully securable to the tray 12 and various pre-existing container holders. This allows the tray 12 to be securely and movably attached to container holders of different sizes (e.g. depths and diameters) such that the cup insert 54 is configured to fit into a pre-existing container holder 28 while the riser 65 provides a sufficient height to the tray 12 such that the tray is positioned above the container holder 28 and thus extending above the user's lap with sufficient clearance between the user's lap and the bottom of the tray 12. The riser 63 allows the tray 12 to rotate or swivel to a position over a user's lap comfortably and without hitting or resting on an average adult's lap or knees given the size of the seat. For example, the lower portion 52 portion may have a riser height 70 ranging from approximately two inches to approximately six or more inches, and for example, may provide a riser height of approximately 2¼ inches, approximately 3¼ inches, approximately 4¼ inches, approximately 5¼ inches or approximately 6¼ inches. Riser height 70 is approximately the distance between a lower end or bottom of the tabs 46 and ring 48 to a bottom surface 72 of the tray 12.

As illustrated in further detail in FIGS. 7-10, a cover 74 may be removably secured to the top of the tray 12. The cover 74, when secured to the tray 12 forms a substantially smooth surface 114 which eliminates the raised outer perimeter of the tray 12 and forms a substantially smooth and even upper facing surface as the cover 144 is substantially level with or only slightly raised above the second surface 18 of the tray 12. The cover 74 may comprise an aperture 76, which can also be used to remove the cover when it is no longer needed. In the embodiment illustrated in the figures, the aperture 76 is substantially centered in the cover 74, however the location of the aperture 76 may be anywhere allowing for easy access by the user. The bottom surface of the cover 74 may comprise one or more lengths 78, 80 integrally extending therefrom. For example, lengths 78 form an outer perimeter wall extending from the bottom surface of the cover along the overall shape of the cover 74 where these lengths 78 prevent the cover from shifting or moving on the tray 12 when the cover is placed over surface 14 to form surface 114 of the tray. A second length 80 may also extend from the bottom surface of the tray around the aperture, providing further stability and/or for supporting the surface 114 when items are placed on top of the tray 12.

A method of using a concession tray and container holder 10 comprises inserting a container holder insert 16 into an aperture 20 in a concessions tray 12 and securing the insert 16 therein by engaging a locking mechanism 52 comprising tabs 26 positioned in the aperture 20 of the tray 12 and configured to engage or connect with corresponding spaces 50 positioned in the container holder insert 16. The lower end 54 of the insert 16 is then inserted into the pre-existing container holder 28, which may be a container holder in an arm rest of a stadium or luxury seat in a suite or at a theater. The tray 12 is then selectively positionable by rotation about the connection of the lower end 54 of the insert 16 and the pre-existing container holder 28. Rotating or swiveling the tray 12 allows for positioning of the tray over the user's lap or off to the user's side and the movement there between. The insert 16 is selectively removable from the pre-existing container holder 28 when the tray 12 is no longer required for use.

Although the present disclosure has been described with reference to preferred embodiments, workers skilled in the art will recognize that changes may be made in form and detail without departing from the spirit and scope of the disclosure.

The invention claimed is:

1. A tray and container holder comprising:

a first, generally flat tray surface configured for supporting one or more concessions thereon and a second, adjacent surface having at least one aperture therein wherein the tray surface and the second adjacent surface are integrally formed;

a cylindrical connecting portion comprising:

a first end configured to form a container holder portion of the tray;

a second opposing end configured for insertion into a pre-existing cup holder of a seat; and a length connecting the first end and the second end wherein the length is configured for adjusting the height of the tray over the pre-existing cup holder; and wherein the connecting portion removably connects the tray to the pre-existing cup holder of the seat by way of insertion of the connecting portion into the at least one aperture and wherein the connecting portion allows the tray to be raised and swiveled about the removable connection of the second opposing end of the connecting portion and the pre-existing cup holder of the seat, allowing the tray to be selectively moved from a first position to a second position and wherein the cylindrical connecting portion is an insert configured for removable connection with the at least one aperture in the surface of the tray.

2. The tray and container holder of claim 1, wherein the second end of the connecting portion is configured for insertion through the aperture of the tray and for insertion into the pre-existing cup holder of the seat and thus extends from a first surface of the tray.

3. The tray and container holder of claim 1, wherein the first end of the connecting portion is configured to receive a container for holding and thus extends from a second opposing surface of the tray.

4. The tray and container holder of claim 1, wherein the length connecting the first and second ends is a riser portion, the height of which may be varied.

5. The tray and container holder of claim 2, wherein the length connecting the first and second ends comprises a securing mechanism configured to secure the connecting portion within the aperture and to prevent vertical movement between the tray and the connecting portion.

6. The tray and container holder of claim 5, wherein the securing mechanism comprises a plurality of tabs integrally extending from the aperture and a corresponding plurality of openings positioned on the connecting portion and wherein when inserting the connecting portion into the aperture, the plurality of tabs and openings are configured for securing the insert to the tray.

7. The tray and container holder of claim 1, wherein the generally flat surface is bounded by a raised perimeter.

8. The tray and container holder of claim 2, the connecting portion having a varying length configured for raising the tray over the seat a selected amount, allowing the tray to swivel between a position raised over the seat portion of the seat and a position adjacent the seat portion of the seat.

9. The tray and container holder of claim 8, wherein the riser height is in the range of approximately two inches to approximately six inches.

10. The tray and container holder of claim 7, and further comprising a securable cover portion that is substantially flat and when secured to the tray, provides a substantially unbounded flat surface.

11. A method of removably and swivelably securing a tray and container holder to a seat comprising:

providing a generally flat surface configured for supporting one or more concessions thereon and having integrally formed aperture therein;

inserting a cylindrical connecting portion into the aperture and the connecting portion having a first end configured to form a container holder portion of the tray and a second end configured for insertion into a pre-existing cup holder of the seat and wherein a length of the connecting portion connects the first end and the second end wherein the length is removably positionable within the aperture and configured for adjusting the height of the tray over the pre-existing cup holder;

inserting second end of the connecting portion into the pre-existing cup holder of the seat such that the first end of the connecting portion is upright for receiving a beverage container therein; and swiveling the tray about the connection of the second end and the cup holder to a selected position for use.

12. The method of claim 11 and further comprising:

swiveling the tray to a second selected position; and removing the first end of the connecting portion from the pre-existing container holder of the seat.

13. The method of claim 12, and providing the connecting portion having a length configured for raising the tray over the seat a selected amount to allow the tray to swivel between a position raised over the seat portion of the seat and a position adjacent the seat portion of the seat.

14. The method of claim 13, wherein a riser height is in the range of approximately two inches to approximately six inches.

15. The method of claim 11, wherein the cylindrical connecting portion is an insert configured for removable connection with an aperture in the surface of the tray and further comprising inserting the first end of the connection portion into the aperture in the tray.

16. The method of claim 15, and further comprising securing the insert to the tray by engaging a securing mechanism configured to prevent vertical movement between the tray and the connecting portion.

17. The method of claim 16, wherein the length connecting the first and the second end comprises a securing mechanism having a plurality of tabs integrally extending from the aperture and a corresponding plurality or openings positioned on the connecting portion and wherein when inserting the connecting portion into the aperture, the plurality of tabs and openings are configured for securing the insert to the tray.

18. The method of claim 11, wherein the generally flat surface is bounded by a raised perimeter.

19. The method of claim 11, wherein the connecting portion has a riser height that is approximately 2¼ inches, approximately 3¼ inches, approximately 4¼ inches, approximately 5¼ inches or approximately 6¼ inches.

* * * * *